United States Patent [19]

Goddard et al.

[11] 4,094,712

[45] June 13, 1978

[54] CONSOLIDATED CHARGES INCORPORATING INTEGRAL IGNITION COMPOUNDS

[75] Inventors: Terrence P. Goddard, Aptos; Donald N. Thatcher, Hollister; Charles G. Garrison, San Jose, all of Calif.

[73] Assignee: Teledyne McCormick Selph, an operating division of Teledyne Industries, Inc., Hollister, Calif.

[21] Appl. No.: 795,473

[22] Filed: May 10, 1977

[51] Int. Cl.[2] ..... C06B 45/28

[52] U.S. Cl. ..... 149/10; 149/9; 149/11; 149/22

[58] Field of Search ..... 260/564 D; 149/22, 9, 149/10, 11

[56] References Cited

U.S. PATENT DOCUMENTS 4,002,681 1/1977 Goddard ..... 260/564 D

*Primary Examiner*—Stephen J. Lechert, Jr.

*Attorney, Agent, or Firm*—David H. Semmes; Warren E. Olsen

[57] ABSTRACT

This invention teaches a method and the resultant product of preparing consolidated propellant charges that incorporate an integral ignition compound, specifically certain simple salts of decahydrodecaboric acid and coprecipitates of these salts with an oxidizer. The charges so prepared exhibit substantially improved ignition and breakup compared to untreated charges, especially at low temperature, because each of the individual consolidated grains are surrounded by the salts taught herein.

19 Claims, No Drawings

CONSOLIDATED CHARGES INCORPORATING INTEGRAL IGNITION COMPOUNDS

CROSS-REFERENCES TO RELATED APPLICATIONS

This application incorporates by reference a copending application of common assignment entitled CO-PRECIPITATED PYROTECHNIC COMPOSITION PROCESSES AND RESULTANT PRODUCTS, Ser. No. 694,626, filed June 10, 1976, which is a continuation-in-part of the application entitled HIGH BURN PROPELLANT COMPOSITIONS, Ser. No. 585,216, filed June 6, 1975, now abandoned.

This application is also a related case to another copending application of common assignment entitled ACTIVE BINDER PROPELLANTS INCORPORATING BURNING RATE CATALYSTS, Ser. No. 696,324, filed June 15, 1976, which related to uniform nitrocellulose-containing propellant compositions, employing the same decahydrodecaborate (−2) compounds which are employed herein. The present invention, in distinction, is not a uniform propellant composition, but is categorically directed to the consolidation of individual grains of an existing propellant composition.

BACKGROUND AND BRIEF DESCRIPTION OF INVENTION

The purpose of this invention is to describe consolidated grain propellant charges which demonstrate significantly better ignition characteristics than state-of-the-art consolidated grain charges. In the design of devices incorporating a propellant, and particularly those devices that use the burning propellant gases to accomplish mechanical work, such as gun ammunition, a controlled amount of gas and heat must be released within a specified time period by the burning propellant. With existing propellants, for example, those based on nitrocellulose, nitrocellulose/nitroglycerine, and nitrocellulose/nitroglycerine/nitroguanidine, and better known to those practiced in the art as "single base," "double base," and "triple base" propellants, respectively, the burning rate of the propellant is fixed within rather narrow limits by the formulation; a major change in propellant formulation is required to significantly alter such characteristics as the basic burning rate. As a result, to control the release of heat and gas in a device such as a rocket motor chamber, gun chamber, or other gas generating device, the propellant is configured into a sometimes complicated three dimensional geometry, known as a "grain," so that the amount of surface burning at a given time is controlled. The inherent burning rate of the propellant and the grain size and geometry determine the burning rate or "quickness" of the propellant mass. The function sequence of the propellant bed burning can be discussed in terms of two events: (1) ignition of the exterior surface of the grain, and (2) regressive burning of the propellant grain. The first event, ignition, depends on the propagation of a flame front, generated by a priming source and burning of those propellant grains ignited first, through the propellant bed. In a loosely packed bed of individual propellant grains, this flame front propagates easily through the interstitial voids in the bed. Often, however, in the design of devices incorporating such packed granular propellants, it becomes very desirable to package the maximum amount of usable chemical energy (in the form of the unburned propellant) into a minimum amount of space. This reduces the overall volume and therefore packaging weight and space of the device. Toward this end, a method has been developed by those practiced in the art, of consolidating a loosely packed propellant bed into an integral grain, thus reducing the overall volume of the propellant mass. The resulting grain is commonly known as a molded charge, "consolidated charge" or "consolidated grain." The amount of interstitial void volume is, of course, reduced in the volume reduction process, thus rendering it more difficult for the initiating flame front to penetrate the deformed, individual grains comprising the propellant mass. The successful ignition of the individual grains, therefore, critically depends on breakup of the consolidated grain and passage of the flame front through the disintegrating mass. With a consolidated charge, it is desirable to have the consolidated or densified propellant burn as effectively as a loosely packed propellant bed. This invention described consolidated charges, fabricated in a manner analogous to state-of-the-art consolidation procedures, though unique in that they incorporate a burning rate enhancing layer as an initial coating, or as a chemically bound surface layer, on the individual propellant grains, which layer is then dispersed as a uniform matrix throughout the consolidated grain mass. The burning rate enhancer, specifically consisting of selected compounds based on decahydrodecaborate (−2) salts, greatly facilitates propagation of the initiating flame front through the propellant mass and breakup of the consolidated grain. The specific burn-rate enhancers taught herein have been found to be unusually effective in promoting the break-up of the individual grains which were deformed together by the consolidation. The charges described by this invention therefore demonstrate significantly better ignition and burning characteristics than similar state-of-the-art consolidated grains at ambient temperature; the improvement is even more marked at low temperature.

DETAILED DESCRIPTION OF THE INVENTION

The present invention describes a method, and resultant product, of manufacturing consolidated propellant charges that incorporate individual grains surrounded by a matrix of an integral ignition composition, specifically ignition compounds that are themselves, or contain, certain salts of decahydrodecaboric acid.

The manufacture of a consolidated charge consists, firstly, of obtaining a suitable propellant in grain or spherical configuration with a range of burning properties and chemical composition of combustion products for the intended purpose, such as accelerating a projectile in a gun. Commonly used granular propellants for this purpose are "single," "double," or "triple base" propellants as known by those practiced in the art, and these propellants may incorporate one or more layers on the grain surface, such as graphite or polymer (known as a "deterrent" layer), to aid in handling or modifying initial ignition characteristics. The individual propellant grains may be configured in spherical or ellipsoidal shapes, representative diameters or average diameters of 0.01 inch to 0.05 inch or more and known as "ball propellant," or cylindrical shapes with one or more longitudinal perforations, with characteristic web dimensions 0.009 inches to 0.03 inches or more. The method taught herein for incorporating the ignition compound into the resulting consolidated grain is general to any of the types of commonly used propellants, and the classes listed and examples presented are not intended to be limiting.

The known consolidation process consists, in general, of applying a solvent or liquid to the desired quantity of loose propellant, placing the wetted propellant in a press mold, and pressing the loose propellant to a set pressing pressure or density. The final charge configuration may be any geometry for which a mold can be fabricated and reasonably uniform density attained during pressing. In normal consolidation procedures, it is desirable to control the propellant and mold temperature between 20° and 60° C. The type and amount of solvent or liquid, the pressing pressure and density, and the temperature at pressing are all dependent on the type of propellant used and the properties and geometry desired of the end configuration. The incorporation of ignition composition is compatible with the preferred ranges of these variables as described herein.

The ignition composition is conveniently introduced into the present consolidation process at the point where the loose propellant is wetted by the solvent or liquid carrier. The compositions useful as ignition aids may be either soluble or insoluble in the solvent or carrier being used, the solubility being dependent on the solvent or carrier type, the ignition composition type and the consolidating temperature.

The ignition compounds useful in this invention are from two general classes; the first, Class (1), being simple salts of decahydrodecaboric acid, and the second, Class (2), being coprecipitates of salts from Class (1) with a suitable oxidizing agent.

The two classes of decahydrodecaborate compounds are defined as follows:

CLASS (1)

The simple decahydrodecaborate salts used in this invention are compounds of the general chemical formula:

$$M_x(B_{10}H_{10})_y$$

where M is a cation or complex cation incorporating hydrogen, nitrogen, carbon, or metals, or some combination thereof, and is further chosen from the list given below; $x$ is the number of M ions; and $y$ is equal to:

$x$ times the valence of the M ion/2

The compounds may further be defined as certain salts of decahydrodacaboric acid, and thus contain as a common ion the decahydrodecaborate (−2) anion $B_{10}H_{10}^{-2}$. The cation M is chosen from the classes:

a. ammonium, $NH_4+$, wherein the salt has the formula $(NH_4)_2B_{10}H_{10}$, and is described by KNOTH U.S. Pat. No. 3,148,938.

b. hydrazinium, $NH_2NH_3+$, wherein the salt has the formula $(NH_2NH_3)_2B_{10}H_{10}$, and is described by KNOTH U.S. Pat. No. 3,148,938.

c. substituted ammonium cations, wherein the salt has the general formula $(R_3NH)_2B_{10}H_{10}$, where R can be hydrogen (H) or alkyl radical (preferred radicals contain less than six (6) carbon atoms). The R's in the preceding formula may represent different alkyl groups. Compounds with two or three hydrogen radicals are described by KNOTH U.S. Pat. No. 3,149,163. Typical cations are methylammonium $(CH_3)NH_3+$, dimethylammonium $(CH_3)_2NH_2+$, trimethylammonium $(CH_3)_3NH+$, and triethylammonium $(CH_3CH_2)_3NH+$.

d. substituted hydrazinium cations, wherein the salt has the general formula $(R_2NNR_2H)_2B_{10}H$, where R can be hydrogen (H) or an alkyl radical (preferred radicals contain less than six (6) carbon atoms), and the substituted alkyl groups can be symmetric or assymetric with respect to the N=N linkage. Symmetric substituted cations are described by KNOTH U.S. Pat. No. 3,149,163. An example of an unsymmetric substituted cation is (1,1) dimethylhydrazinium. The R's in the preceding formula may be mixed alkyl radicals.

e. quaternary ammonium salts of the general formula $(R_4N)_2B_{10}H_{10}$, where R is an alkyl radical; the R's in the preceding formula may represent mixed alkyl groups. Examples of typical cations are tetramethylammonium $(CH_3)_4N^+$ and tetraethylammonium $(CH_3CH_2)_4N^+$.

f. aryl containing cations, such as pyridinium, bypyridinium, or substituted aryl cations, such as aryldiazonium cations.

g. guanidinium ion, $C(NH_2)_3^+$, wherein the salt has the formula $(C(NH_2)_3)_2B_{10}H_{10}$, and is described in an application of common assignment, entitled BIS-GUANIDINIUM DECAHYDRODECABORATE AND A PROCESS FOR ITS PREPARATION, filed June 10, 1976 and now U.S. Pat. No. 4,002,681.

h. metal ions, derived from metals defined by a Periodic Table such as that in the "Handbook of Chemistry and Physics", 54th Edition, inside front cover, by the elements in Groups 1, 2, 8, 3*b*, 4*b*, 5*b*, 6*b* and 7*b*, and the elements of Groups 3*a*, 4*a*, 5*a* and 6*a* with atomic numbers greater than 5, 14, 33, and 52, respectively. The metal decahydrodecaborate salts are further described by KNOTH U.S. Pat. No. 3,148,939. Examples of such metal salts are $Cs_2B_{10}H_{10}$ and $K_2B_{10}H_{10}$, the cesium and potassium salts of decahydrodecaboric acid, which are representative of alkali metal salts preferred for the compositions described in this invention.

CLASS (2)

An intimate blend of the compounds described in Class (1) above, with an oxidizing agent, in a manner that a chemically and physically different product is obtained than the starting materials.

The process by which the compositions of this class are prepared produces a very intimate blend of decahydrodecaborate (−2) ion with the oxidizer and makes the compositions so prepared chemically and physically unique from physical blends of decahydrodecaborate (−2) salts with oxidizer or pyrotechnic compositions incorporating decahydrodecaborate (−2) salt, as described above, and also dissolving, in the same solution, an oxidizing agent, as described above. The subject composition is recovered by precipitating the composite ingredients of the solution with a suitable nonsolvent. The resulting solid, after filtration and drying, comprises and intimate mixture of the decahydrodecaborate (−2) anion with the oxidizing cation or substance, in a form that is chemically and physically different than the starting materials.

The process may be properly called a "cocrystallization" or "coprecipitation" and the resulting produce a "cocrystallate" or "coprecipitate."

These unique coprecipitated Class (2) salts, containing the $B_{10}H_{10}^{-2}$ anion, and the process for their creation, are themselves further disclosed in a copending patent application of common assignment entitled, "COPRECIPITATED PYROTECHNIC COMPOSITION PROCESSES AND RESULTANT PRODUCTS," filed June 10 1976, assigned Ser. No. 694,626, which is incorporated herein by reference.

The ignition compounds may be soluble or insoluble in the solvent or liquid carrier. The solvent or liquid carriers used in consolidating grains are of such a type that the propellant ingredients will not react with the contacting liquid. The purpose of the solvent or carrier is to provide a softening and/or wetting of the propellant surfaces in order that the individual grains will readily compact during the consolidating process and remain sealed together to form an integral charge after consolidation. For this purpose, a wide variety of chemically pure solvents and vehicles or mixtures of these solvents and vehicles may be used by those practiced in the consolidating process, to control such various terminal parameters as charge density and grain-to-grain structural integrity, or gross grain physical properties. Preferred solvents and vehicles which are compatible with common propellant ingredients include those with functional organic groups such as ketones (acetone, methyl ethyl ketone, methyl isobutyl ketone); alcohols (methanol, ethanol, isopropanol, butyl alcohols, diacetone alcohol), esters (butyl acetate, ethyl acetate, dibutylphthalate); ethers (ethyl ether, isopropyl ether). Other solvents and vehicles which meet the solubility, nonreactivity, and volatility requirements to achieve consolidation are available, and the above list is not meant to be limiting. Mixtures of the forementioned solvents are commonly used to control one or more critical parameters. Some mixtures may contain a small amount of adhesive to improve grain-to-grain integrity, such as collodion (4 grams pyroxylin (chiefly nitrocellulose) in 100 ml of a mixture of 1 volume ethanol and 3 volumes ethyl ether). It should be noted that some solvents, in particular those containing dibutylphthalate act so as to achieve a deterring layer at the grain-grain interface, thus reducing ignition efficiency (which may be desirable for some applications).

The ignition compositions, depending on the class, which are the key elements in the process and product taught by this invention, may be soluble or insoluble in the solvent or carrier used in the consolidating process, and furthermore the choice of solvent or carrier system depends somewhat on the type of ignition compound to be used.

The simple decahydrodecaborate salts, represented by Class (1) of the preceding list of the specific ignition aides, may be soluble or insoluble in the solvent or vehicle system used. A critical requirement of the use of these simple salts is an intimate contact with the individual propellant grain ingredients (particularly nitrocellulose with or without nitroglycerine), which must act as oxidizers to combust the salt, which acts as a fuel. The result of the intimate interface of binder oxidizer and fuel is a layer which will have a faster burning rate than the original propellant composition, and one which lies both on the exterior surface of the original propellant grains and forms a matrix between the grain-to-grain boundaries.

To achieve the required intimate contact between propellant oxidizer and decahydrodecaborate salt, it is preferrable that the salt either be dissolved in the solvent or vehicle, or be of a very fine particle size that is suspended in the solvent fluid. Ten microns average diameter is a preferred upper limit on the average diameter of undissolved salt crystals.

Representative examples of Class (1) decahydrodecaborate salts dissolved in a solvent carrier system are bis-ammonium decahydrodecaborate in acetone/ethanol or isopropanol, and dipotassium decahydrodecaborate in acetone/ethanol. The solubility of the decahydrodecaborate salts in solvent systems varies considerably, and must be considered separately for each individual case. In general, the decahydrodecarborate salts with relatively small cations, as represented by Class 1(a) and 1(b) and certain members of Classes 1(c) (such as methylammonium or dimethylammonium), 1(d) and 1(h) (such as sodium or potassium), are more likely to be soluble in selected members from the list of solvents than salts with larger molecular weight cations, for example, cesium or tetramethylammonium. It is desirable to initially dry, i.e., remove water, from the prepared solutions by, for example, letting the prepared solutions stand over calcium sulfate, or other drying agent, in order to avoid introducing excess moisture into the consolidated charges.

Examples of useful decahydrodecaborate salts insoluble in most solvents and carriers are tetramethylammonium decahydrodecaborate and dicesium decahydrodecaborate, which may be incorporated into a surface layer by suspending them in a carrier which has some solvent ability on the propellant as for example, butyl acetate/ethanol, acetone/ethanol, or ether/acetone mixtures. The solvent with the suspended decahydro-decaborate salt is applied to the propellant in the same manner as the pure solvent. In either case, a distinguishable layer of the salt is formed around the individual propellant grains.

It should now be emphasized that the decahydrodecaborate compounds of Class 2, i.e., decahydrodecaborate salts coprecipitated with an oxidizer, must be insoluble in the consolidation fluid, in order that the intimate crystalline structure of the coprecipitate is not degraded. As with the insoluble simple salts, the Class 2 compounds may be suspended in the propellant solvent or vehicle. In contrast to the insoluble simple salts of Class 1, the Class 2 coprecipitates are self combusting, and do not require interface with the oxidative ingredients of the propellants to achieve ignition enhancement. They may thus be applied in an outer layer in such a manner that the propellant solvent/suspended ignition carrier system does not penetrate as deeply into the surface of the individual propellant grains as that for the Class 1 compounds, for example by using a carrier such as isopropanol, which does not have appreciable solvent ability on typical propellants, but which will soften the propellant surface sufficiently for the Class 2 ignition compounds to adhere to the surface, forming an outer layer. Examples of Class 2 ignition composition and acceptable solvent carriers are the coprecipitate of 25-parts-by-weight cesium decahydrodecaborate and 75-parts-by-weight potassium nitrate with isopropanol, butyl acetate/ethanol, acetone/ethanol, or ether/ethanol carriers and the coprecipitate of 15-parts-by-weight tetramethylammonium decahydro-decaborate and 85-parts-by-weight potassium nitrate with the same carriers.

The consolidation process may first include dissolving or suspending the decahydrodecaborate compound in a predetermined concentration in the solvent or carrier. The amount of propellant solvent fluid preferred for the consolidation process is between 0.010 and 0.100 milliliters of fluid (for solution or suspension of the salt compounded) per gram of propellant. The preferred limits on decahydrodecaborate compounds are, as follows:

Class 1 soluble: 0.1 to 1.0% of the total propellant weight;

Class 1 insoluble: 0.3 to 2.0% of the total propellant weight;

Class 2: 0.5 to 4.0% of the total propellant weight. The required concentration of the ignition compound in the consolidating fluid may be calculated for each case from the amount of fluid to be used and the percent concentration of the ignition compound desired.

The propellant is wetted with the requisite amount of the solution or suspension and mixed well; in normal practice the solution or suspension is rapidly absorbed by the propellant to give a dry appearance. The propellant is then consolidated in the accepted fashion, at which time the individual wetted grains are fused into a charge with the desired density. The ignition compositions remain in a surface layer of variable thickness (depending on the solvent power of the consolidating fluid) on the exterior surfaces remaining on the individual grains or encompassed between the fused grain-to-grain boundaries formed during the consolidation. This new matrix layer formed provides a fast burning channel through the consolidated charge bed, which aids in flame front propagation and charge breakup, and, as well, aids the propellant ignition uniformly over the individual grain surfaces. The decahydrodecaborate salt may be considered a burning rate catalyst or ignition enhancer seeded into the propellant surface or, alternatively, the layer may be considered as a new propellant composition with a burn rate higher than the propellant initially present in the grain, the two interpretations being one and the same, and physically equivalent.

The consolidated charge assemblies prepared by this method, after a suitable drying period, exhibit substantially better ignition properties than untreated units. The effect of the introduction of the ignition composition directly into the consolidated charge is to place the ignition stimulus in very intimate contact with, in fact, as part of, the propellant surface, so as to achieve a direct heat input into the surface of each individual grain. The fast transfer of the ignition impetus throughout the consolidated charge facilitates grain breakup, which is quite necessary for proper overall propellant charge function.

The ignition enhancement is illustrated by the following examples.

EXAMPLE I

A typical single base propellant, consisting of approximately 91.85% nitrocellulose, 0.5% diphenylamine, 0.15% potassium sulfate, 5.6% methyl centralite as a deterrent coating, 0.4% graphite as a glazed layer, and 1.5% residual moisture and volatiles, such as can be purchased as Canadian Industries Ltd. (CIL) #5479, is chosen as representative of the class of single, double and triple base granular propellants considered in this invention. A consolidation process is employed whereby the propellant grains are treated with a mixture of 65%-by-volume of ethanol and 35%-by-volume of acetone, in the ratio 0.05 milliliters of solution per gram of propellant. The wetted, loose propellant grains are placed in a die maintained at 30° centigrade and pressed at 13,000–15,000 pounds per square inch for 30–60 seconds. The die used in these examples has a diameter of 0.50 inches; two grams of propellant are used, giving a consolidated pellet of length approximately 0.50 inches.

The present invention involves introducing the decahydrodecaborate compound into the process as the propellant is being wetted and prepared for pressing; as by tumbling the wetted propellant grains in the required amount of decahydrodecaborate compound powder. In this example, a decahydrodecaborate compound consisting of 15%-by-weight tetramethylammonium decahydrodecaborate (−2) coprecipitated with 85%-by-weight potassium nitrate, which is representative of decahydrodecaborate compounds of Class (2), is used. This compound is insoluble in the solvent mixture, and deposits in a solid coating on the individual grain surfaces. A series of pellets consisting of pure propellant (control samples) and varying amounts of the decahydrodecaborate compound is prepared according to Table I.

The pellets are tested by mounting the pellet in a closed bomb of approximately 100 cc free volume pressured to 1,000 pounds per square inch gauge. A small area of the pellet is placed in contact with a nichrome wire. A current of several amps applied to the wire ignites the pellet. pressure-vs-time for the ignition and burning sequence is recorded on a fast oscillograph.

The primary criteria, as shown in Table I, for comparison between control units and decahydrodecaborate compounds is the ignition time, defined as the first measurable deviation from the starting pressure baseline to 10% of the peak pressure. The propellant grains incorporating the decahydrodecaborate compound show a marked improvement in the ignition time. Moreover, the pressure traces show a much better defined deviation from baseline than control units. Other significant criteria, also shown on Table I, are the peak pressures obtained, the time between deviation from baseline and peak pressure, and the slope of the curve between the 10% and 90% ($(dP/dt)_{10\text{-}90}$) of peak pressure points. The pellets incorporating the decahydrodecaborate compound are superior to the control units in all respects, except that the $(dp/dt)_{10\text{-}90}$) of the unit having 4.9% decahydrodecaborate compound is lower than the control units. This establishes an upper limit to the concentration of compound in the pellet.

Table I

| Pellet Type | Decahydrodecaborate Compound % | Ignition Time Milliseconds | Peak Pressure pounds per square Inch Gauge | Time to peak Pressure | $(\frac{dP}{dt})_{.10\text{-}.90}$ (PSI/MSEC) |
|---|---|---|---|---|---|
| A (Control) (Units A-1) (and A-2) | 0 | 9.8/11.0 | 2113/2063 | 36.0/37.4 | 91.9/90.7 |
| B | 1.4 | 5.6 | 2400 | 30.0 | 102.1 |
| C | 2.3 | 6.2 | 2200 | 31.2 | 101.1 |
| D | 3.1 | 7.4 | 2275 | 30.1 | 112.4 |

Table I-continued

| Pellet Type | Decahydrodecaborate Compound % | Ignition Time Milliseconds | Peak Pressure pounds per square Inch Gauge | Time to peak Pressure | $(\frac{dP}{dt})_{.10-.90}$ (PSI/MSEC) |
|---|---|---|---|---|---|
| E | 4.9 | 1.2 | 2125 | 35.6 | 83.0 |

EXAMPLE II

A series of pellets, using the same propellant as Example I are pressed, incorporating decahydrodecaborate compounds as described in Table II. The control units F, and the units G containing 15%-by-weight tetramethylammonium decahydrodecaborate coprecipitated with 85%-by-weight potassium nitrate, are manufactured in a manner identical with Example I.

A third set of units -H- incorporates bisammonium decahydrodecaborate, a pure simple salt from Class 1(a) which is representative of salts and decahydrodecaborate compounds which are soluble in the consolidating solvent. In this procedure, the decahydrodecaborate salt is dissolved in the solvent at the desired concentration, in this case 0.9g salt per 100 ml solution, and the consolidation process done in a manner otherwise identical with Example I.

Representative pellets are tested at ambient temperature (circa 70° F) in a manner identical to Example I, except that the bomb volume is slightly larger, 125 cc (thus peak pressures are lower than Example I). The critical parameters of the pressure-vs-time traces are shown in Table II. The control units F, as well as the G units, exhibit behavior similar to that as found in Example I. The soluble Class I(a) decahydrodecaborate compounds, units H, also demonstrate a pronounced ignition enhancement.

Additional units of configuration F, G and H are fired in the identical closed bomb except that the bomb and pellet are conditioned to −65° F at firing. The units incorporating decahydrodecaborate compounds from both Class I and II demonstrate significantly improved ignition characteristics over that of the control at this low temperature. The ignition time, as defined in Example I, is faster than the control units at ambient temperature, and are as shown in Table III.

TABLE II (70° F)

| Pellet Type | Decahydrodecaborate Compound % | Ignition Time (MSEC) | Peak Pressure (PSI) | Time to Peak Pressure (MSEC) | $(\frac{dP}{dt})_{.10-.90}$ (PSI/MSEC) |
|---|---|---|---|---|---|
| F (Control) | 0 | 14 | 1600 | 47 | 63.5 |
| G | 2.0[1] | 4.0 | 1855 | 27.0 | 92.8 |
| H | 0.44[2] | 3.5 | 1763 | 29.0 | 110.2 |

[1]Decahydrodecaborate, Class II
[2]Decahydrodecaborate, Class Ia

TABLE III (−65° F)

| Pellet Time | Decahydrodecaborate Compound % | Ignition Time (MSEC) | Peak Pressue | Time to Peak Pressure (MSEC) | $(\frac{dP}{dt})_{.1-.9}$ (PSI/MSEC) |
|---|---|---|---|---|---|
| F (Control) | 0 | 25-30 | 850-1000 | 55-67 | 32-40 |
| G | 2.0-3.0[1] | 2-5 | 1040-1200 | 35-39 | 47-59 |
| H | 0.44[2] | 6-9 | 950-1060 | 34-36 | 44-54 |

[1]Decahydrodecaborate, Class II
[2]Decahydrodecaborate, Class I(a)

EXAMPLE III

A single base propellant, consisting of approximately 91.0% nitrocellulose, 0.7% diphenylamine, 0.3% potassium sulfate, 5.2% ethylene dimethacrylate and 0.4% graphite as a coating, and 2.5% residual moisture and volatiles, such as can be purchased as DuPont smokeless powder 8472-1, is chosen as a representative propellant which is relatively difficult to ignite.

A consolidation process identical with Examples I and II is used to fabricate pellets containing 0 and specified amounts of decahydrodecaborate compounds of Class I and Class II as represented in Table IV. The pellets are ignited, at ambient and low temperature, with parameters measured and recorded in Table IV, in an identical manner with Example II. The critical parameters of the pressure-vs-time traces for each event are shown in TABLE IV.

As with Example II, the units incorporating decahydrodecaborate compounds show marked ignition enhancement, especially at reduced temperatures.

TABLE IV

| Pellet Type | Decahydrodecaborate Compound % | Temperature at Ignition | Ignition Time (MSEC) | Peak Pressure (PSI) | Time to Peak Pressure (MSEC) | $(\frac{dP}{dt})_{.1-.9}$ (PSI/MSEC) |
|---|---|---|---|---|---|---|
| I | 0 | 70° F | 10.5 | 1790 | 31 | 143 |
| | | −65° F | 60-104 | 800-1025 | 141-180 | 11-23 |
| J | 1.7-2.7[1] | 70° F | 1.5 | 1780 | 19 | 142 |
| | | −65° F | 1-1.5 | 920-1090 | 40-48 | 22-38 |
| K | 0.44[2] | 70° F | 4 | 1730 | 19 | 173 |
| | | −65° F | 7-12 | 750-960 | 40-55 | 21-36 |

[1]Decahydrodecaborate Compound, Class II.
[2]Decahydrodecaborate Compound, Class I(a).

In summary, the above representative examples illustrate the synergistic results obtainable when a process of consolidating a granular nitrocellulose-base propellant includes the novel step of incorporating a layer of specific decahydrodecaborate compounds, on the exterior of each grain before the consolidation step. The decahydrodecaborate compound specified herein may normally be thought of as a high energy fuel, however, the small percentages of them in the instant process do not explain the unexpected enhanced ignition which have been shown by the representative examples. Rather, the present invention involves the synergistic combination of an additional fuel upon the propellant grains, despite the fact that the propellants themselves are known to be fuel-rich. The present invention critically depends upon the decahydrodecaborate anion, which is believed to be kinetically, rather than thermodynamically stabilized. There is no critical distinction between whether or not the cation of the salt is organic, or inorganic, since any degradation present in a heavy cation is far outweighed by the energetic activity of the decahydrodecaborate anion, when it is proximate the grain-to-grain boundaries between the compacted propellant grains. The fact that the ignition layer resulting from the process taught herein is not simply a fuel is manifestly illustrated by the illustrations in Table I, which unexpectedly show an upper limit to the concentration of representative ignition compounds according to the present invention.

While specific embodiments of an improved process for consolidating charges of nitrocellulose-based granular propellants have been illustrated herein, together with unique products obtainable according to this process, it is understood that the illustrative examples are merely representative, and that subject matter in which an exclusive property or privilege is claimed is to be defined solely by the scope of the appended claims, as follows.

We claim:

1. In a process for consolidating a charge of nitrocellulose-based propellant grains, the improvement of incorporating an ignition compound matrix comprised of certain decahydrodecaborate compounds, through the steps of:

(A) wetting loose propellant grains on their exterior surfaces with a consolidating fluid having a solvating effect on said grains, the consolidating fluid being in the range of approximately 0.010 to 0.100 milliliters of fluid per gram of propellant, and, (B) introducing a layer of decahydrodecaborate compound onto the exterior surfaces of said grains as the result of the wetting effect of said consolidating fluid, wherein said compound is in the range of approximately 0.1% to 4.0% of the total propellant weight, wherein said compound further includes a salt selected from the class of salts having the common anion $B_{10}H_{10}^{-2}$, and a cation selected from the group consisting of:

(i) ammonium, wherein the salt has the formula $(NH_4)_2B_{10}H_{10}$;

(ii) hydrazinium, wherein the salt has the general formula $(NH_2NH_3)B_{10}H_{10}$;

(iii) metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52; and (C) consolidating the thusly wetted propellant grains into a consolidated charge by a compaction step, wherein the decahydrodecaborate compound layer on each grain becomes a matrix between the grain-to-grain boundaries of the consolidated charge.

2. The process according to claim 1 wherein the decahydrodecaborate compound selected is soluble in the consolidating fluid, and the step of introducing said compound further consists of first dissolving said compound in said fluid, and wetting the exteriors of said propellant grains with the solution in order to form said layer on each grain.

3. The process according to claim 1 wherein the decahydrodecaborate compound selected is insoluble in the consolidating fluid, and the step of introducing said compound further consists of first suspending compound particles of approximately ten microns average diameter in said fluid, and wetting the exterior of said propellant grains with the suspension in order to form said layer on each grain.

4. The process according to claim 1 wherein said compound is insoluble in said fluid and is the resultant product of a coprecipitation of one of said salts with a solid oxidizing agent by the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

5. The process according to claim 1 wherein the step of introducing said compound further consists of first wetting the propellant grains and then tumbling the wetted grains in a powder of said compound in order to form said layer in each grain.

6. The process according to claim 1 wherein said granular nitrocellulose based propellant is selected from the group consisting of nitrocellulose, nitrocellulose/nitroglycerine, and nitrocellulose/nitroglycerine/nitroguanidine based gun propellants.

7. The process according to claim 1 wherein the consolidating fluid having a solvating effect on said propellant includes one or more members from the group consisting of:

acetone,
methyl ethyl ketone,
methyl isobutyl ketone,
methanol,
ethanol,
isopropanol,
butyl alcohols,
diacetone alcohol,
butyl acetate,
dibutylphthalate,
ethyl ether and
isopropyl ether.

8. The process according to claim 6 wherein the granular propellant selected is nitrocellulose based, said decahydrodecaborate compound selected in bisammonium decahydrodecaborate, said consolidation fluid is a mixture of approximately 65% by volume ethanol and 35% by volume acetone, and said introducing step further consists of first dissolving approximately 0.9 gram of said salt per 100 milliliter of said fluid prior to said wetting step.

9. The product of a consolidated charge according to the process of claim 8.

10. A process according to claim 4 wherein the decahydrodecaborate compound selected is a simple metallic salt selected from the group consisting of cesium decahydrodecaborate, $Cs_2B_{10}H_{10}$, potassium decahydrodecaborate $K_2B_{10}H_{10}$, and the simple metallic decahydrodecaborate salts of the alkaline and alkaline earth metals of Groups 1*a* and 2*a* having an atomic number less than 87.

11. In a process for consolidating a charge of nitrocellulose-based propellant grains, the improvement of incorporating an ignition compound matrix comprised of certain decahydrodecaborate compounds, through the steps of:

(A) wetting loose propellant grains on their exterior surfaces with a consolidating fluid having a solvating effect on said grains, the consolidating fluid being in the range of approximately 0.010 to 0.100 milliliters of fluid per gram of propellant; and, (B) introducing a layer of decahydrodecaborate compound onto the exterior surfaces of said grains as the result of the wetting effect of said consolidating fluid, wherein said compound is in the range of approximately 0.1% to 4.0% of the total propellant weight, wherein said compound further includes a salt selected from the class of salts having the common anion $B_{10}H_{10}^{-2}$, and a cation selected from the group consisting of:

(i) substituted ammonium cations, wherein the salt has the general formula $(R_3NH)_2B_{10}H_{10}$, wherein further R is selected from the group consisting of hydrogen and alkyl radicals containing less than six carbon atoms;

(ii) substituted hydrazinium cations, wherein the salt has the general formula $(R_2NNR_2H)_2B_{10}H_{10}$ wherein further R is selected from the group consisting of hydrogen and alkyl radicals containing less than six atoms;

(iii) tetramethylammonium, $(CH_3)_4N+$, tetraethylammonium, $(CH_3CH_2)_4N+$, and quaternary ammonium cations having the general formula $R_4N+$ where R is an alkyl radical;

(iv) pyrididinium, bipyridinium aryl-diazonium, aryl containing cations and substituted aryl containing cations.

(v) the guanidinium cation, $C(NH_2)_3+$; and, (C) consolidating the thusly wetted propellant grains into a consolidated charge by a compaction step, wherein the decahydrodecaborate compound layer on each grain becomes a matrix between the grain-to-grain boundaries of the consolidated charge.

12. The process according to claim 11 wherein the decahydrodecaborate compound selected is soluble in the consolidating fluid, and the step of introducing said compound further consists of first dissolving said compound in said fluid, wetting the exteriors of said propellant grains with the solution in order to form said layer on each grain.

13. The process according to claim 11 wherein the decahydrodecaborate compound selected is insoluble in the consolidating fluid, and the step of introducing said compound further consists of first suspending compound particles of approximately ten microns average diameter in said fluid, and wetting the exteriors of said propellant grains with the suspension in order to form said layer on each grain.

14. The process according to claim 11, wherein said compound is insoluble in said fluid and is the resultant product of a coprecipitation of one of said salts with a solid oxidizing agent by the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

15. The process according to claim 11 wherein the step of introducing said compound further consists of first wetting the propellant grains and then tumbling the wetted grains in a powder of said compound in order to form said layer on each grain.

16. The process according to claim 11 wherein said granular nitrocellulose based propellant is selected from the group consisting of nitrocellulose, nitrocellulose/nitroglycerine, and nitrocellulose/nitroglycerine/nitroguanidine based gun propellants.

17. The process according to claim 11 wherein the consolidating fluid having a solvating effect on said propellant includes one or more members from the group consisting of:

acetone,
methyl ethyl ketone,
methyl isobutyl ketone,
methanol,
ethanol,
isopropanol,
butyl alcohols,
diacetone alcohol,
butyl acetate,
dibutylphthalate,
ethyl ether and
isopropyl ether.

18. The process according to claim 14 wherein the coprecipitated decahydrodecaborate compound is approximately 15% to 25% by weight tetramethylammonium decahydrodecaborate and the remainder an oxidizing agent selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate, wherein further the consolidating fluid includes one or more members selected from the group consisting of isopropanol, butylacetate/ethanol, acetone/ethanol, and ether/ethanol.

19. The product of a consolidated charge according to the process of claim 18.

* * * * *